United States Patent [19]

Bromley

[11] 4,038,746

[45] Aug. 2, 1977

[54] OPENER FOR A COIN PACKAGE

[76] Inventor: Meryl L. Bromley, R.R. 5, Meadowbrook, Dowagiac, Mich. 49047

[21] Appl. No.: 644,103

[22] Filed: Dec. 24, 1975

[51] Int. Cl.[2] ..... B26B 27/00

[52] U.S. Cl. ..... 30/2; 220/277; 81/3.46 R; 133/1 R; 225/102

[58] Field of Search ..... 30/1, 1.5, 2, 22, 165, 30/353; 81/3 R, 3.46 R, 3.46 A, 3.34; 133/1 R; 229/87.2; 220/277, 284, 285; 225/93, 102, 103

[56] References Cited

U.S. PATENT DOCUMENTS

| | | | |
|---|---|---|---|
| 517,268 | 3/1894 | Donovan | 30/22 X |
| 1,453,956 | 5/1923 | Smith | 30/165 X |
| 1,638,956 | 8/1927 | Pinchbeck | 30/353 X |
| 2,694,326 | 11/1954 | Lewis | 81/3 R |

FOREIGN PATENT DOCUMENTS

| | | | |
|---|---|---|---|
| 1,050,218 | 2/1959 | Germany | 81/3.34 |

*Primary Examiner*—Gary L. Smith

*Attorney, Agent, or Firm*—Blanchard, Flynn, Thiel, Boutell & Tanis

[57] ABSTRACT

Opening device for a package of coins. For the opening of packages of coins, there is provided a keylike device having a handle portion and two prongs at one end thereof spaced from each other and projecting from such end in generally parallel relationship to each other. One of said prongs is straight-sided and adapted for lying against the outside of a coin package when the device is in use. The other of said prongs is relatively shorter, is spaced from the first prong a distance slightly greater than the thickness of the rim of the packages with which said device is to be used and has a portion projecting from the end thereof in the direction remote from said first prong. In use, said device is placed with said first prong outside of the package and the second prong adjacent the inside of the rim of said package and the key is twisted to bring said projection against or under the free edge of said rim. Said key is then rocked to lift said rim and simultaneously further twisted to tear said package open.

6 Claims, 5 Drawing Figures

OPENER FOR A COIN PACKAGE

FIELD OF THE INVENTION

The invention relates to an opening device for a package of coins and particularly to one adapted for manual use.

BACKGROUND OF THE INVENTION

The assembling of coins for convenient handling into paper-wrapped packages has long been known and recognized as a convenient way for the handling, transporting or other manipulation of large numbers of coins. The wrapping of such coins has also long been known and has been carried out rapidly and efficiently, often by automatic machinery but methods are also known for wrapping same by hand. Said wrappings are tight and in order to enable said packages to stand a considerable amount of handling and possible abuse, said wrappings are deliberately made to firmly and strongly resist unwrapping.

However, when the time comes to use such coins and the unwrapping thereof is necessary, the resistance of such wrappings to unwrapping becomes a disadvantage which has been recognized for a long time. In many cases, the packages of coins are merely broken over a sharp edge such as a desk corner or some portion of a cash register but this, while a common procedure, generates the risk of coins being spilled on a table or on the floor and may dent or crack the article against which the coin package is struck. Other methods and devices have been offered to the public for opening packages of coins but insofar as I am aware none of these comprise a simple keylike device, readily made by an inexpensive means such as metal stamping, and easily carried in a pocket of the user but which at the same time is convenient and effective in use.

Accordingly, the objects of the invention include:

1. To provide a device for opening wrapped packages of coins in a simple, efficient and convenient manner.
2. To provide such a device which is sufficiently small that it can be easily carried in the pocket of a user.
3. To provide such a device which is of sufficient structural simplicity that it can be readily made by inexpensive means such as metal stamping.
4. To provide a device which will tear apart the coin package in such a manner that the user maintains complete control over the coins within the package and thereby minimizes the danger of same falling or spilling.
5. To provide a device, as aforesaid, which will have reasonable flexibility with respect to the size of the packages with which same is used so that a single opener can be readily used for all, or at least many, sizes of coin packages.
6. To provide such a device having sufficient leverage built thereinto that the necessary tearing of the coin package even though at the rim thereof can be accomplished easily and without the expenditure of excessive strength.

Other objects and purposes of the invention will be apparent to persons acquainted with devices of this general type upon reading the following specification and inspection of the accompanying drawings.

SUMMARY OF THE INVENTION

Figure 1:
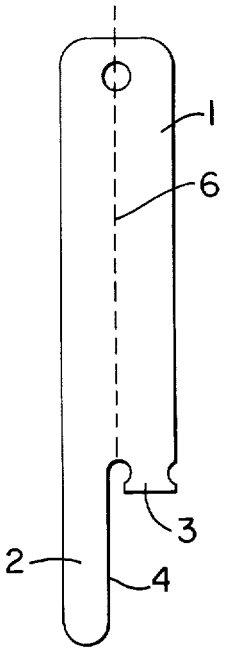
FIG. 1 shows a side view of one embodiment of the invention.
Figure 2:
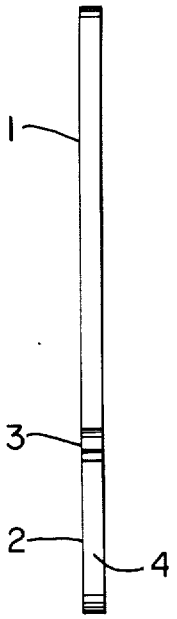
FIG. 2 shows an end or edge view thereof.

Briefly, said invention comprises a keylike device having a handle portion and a pair of spaced prongs projecting parallel with respect to each other from one end of such handle. One of said prongs is relatively long for lying alongside of the coin package and the other is relatively short for bearing against the end of the coin package when the two prongs are positioned to straddle the rim of a coin package. A small projection extends from the end of the shorter prong in the direction away from the longer prong and is intended to extend against or under the turned-over edge of the coin package for engaging and often partially lifting same as the opening device is twisted in a package opening operation.

DETAILED DESCRIPTION

Referring now to the drawings, there is shown an opening device comprising a handle portion 1 with a pair of generally parallel prongs 2 and 3 spaced from each other and extending from one end of such handle. The prong 2 is relatively long and has an edge 4 aligned generally parallel with the longitudinal centerline 6 of the handle. The shorter prong 3 has an end surface 7 with a first lateral scallop 8 on one side thereof and a second lateral scallop 9 on the other side thereof. The purpose of the scallop 8 will appear further hereinafter. The purpose of the scallop 9 is to define a point 11 extending laterally from the prong 3 in a direction opposite to the positioning from said prong 3 of the prong 2. It will be noted that the scallop 9 causes the projection 11 to terminate substantially in a point and defines a ramp 12 extending upwardly from said point.

The spacing between the prongs 2 and 3 is sufficient to enable said prongs to straddle the turned-over edge of a coin package and to do so freely and easily but without excessive freedom with respect thereto. The length of the shorter prong 3 is such that its end 7 will approach at least close to and preferably bear onto, the end member of the package with the upper end 13 of the spacing between said prongs close to or touching the rim of such package. The width of the prong 3 is such that it can extend across a chord of the coin package when said opener is twisted as further described hereinafter so that the point 11 will bear against the inside of the rim of the package while the midpoint of the shorter prong 3 is spaced at least a measurable distance from the inside of such rim.

These dimensions will, however, accept a rather wide range of tolerances and the considerations under which such dimensions must be chosen will appear further hereinafter in the discussion relating to operation of the opening device.

Figure 3:
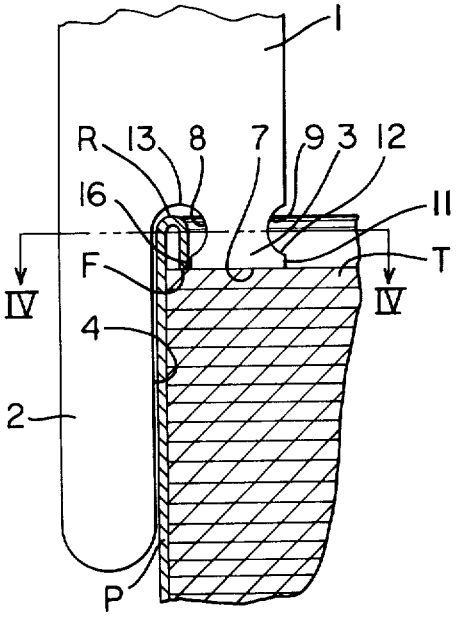
FIG. 3 is a fragmentary view showing the manner of placing the opening device onto a package of coins in position for opening.

Turning now to such operation, same is simple and is largely indicated in the drawings. The device is placed as shown in FIG. 3 with the prongs 2 and 3 straddling the rim R of a coin package P, same having a top member T (a coin or a cardboard disk) against which bears the free end F of the turned-over rim. This is a standard form of coin package and will be readily recognized by those acquiainted with the art.

Figure 5:
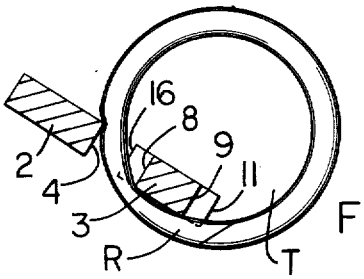
FIG. 5 shows the same section as FIG. 4 in a different position of operation.

With the opening device in the position shown in FIG. 3, same is rotated approximately about a longitudinal centerline through the middle of the spacing between the two prongs in either direction until the projection 11 contacts the inside of the rim R. The position when same is rotated in a clockwise direction is shown in FIG. 5. Further pressure in the same direction will force the point 11 against or under the end F of the coin package rim, often lifting same slightly as it tends to ride up the ramp 12. Still further rotation in the same direction will tear the rim at the point at which it is engaged by the projection 11 and still further continued rotation in the same direction will tear the side of the coin package open to expose the coins to whatever extent is desired. Such tearing is, however, under complete control and is accomplished by only one hand of the user. Therefore, his other hand is available to hold the coin package and to receive and control the coins exposed by the above-described tearing of the package.

Figure 4:
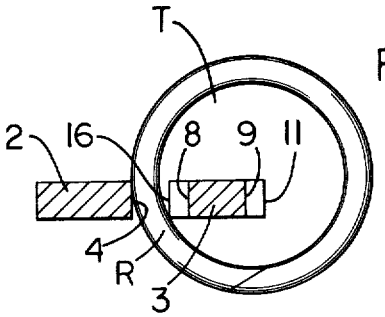
FIG. 4 is a section taken on the line IV—IV of FIG. 3.

It will be apparent from an inspection of FIG. 4 that to accomplish the most effective tearing of the package, the twisting force should preferably be concentrated onto the package by the point 11 and for this purpose the remainder of the prong 3 should preferably be spaced appreciably from the rim of the package. On the other hand, it will be equally apparent that the desired concentration of force may be obtained with the prong 3 spaced as shown in FIG. 5 or spaced a distance substantially greater. Therefore, it will be apparent that a given opening device may be used with a wide variety of different sizes of coin packages. Further, while the above relationship is preferable, it will also be apparent that with a slightly greater force applied to the opening device, it will be effective even if the prong 3 lies in substantially continuous contact with the package rim, as would be the case if it were used with a relatively large package such as a package of half dollars.

At this point, it will be apparent that the purpose of the cutout 8 is to enable the opening device to turn from the position indicated in FIG. 3 at which it is substantially on a diameter of the coin package into the position shown in FIG. 4 without meeting material resistance between the rim of the package and the part relieved by cutout 8. The cutout 8 will also enable the opener to avoid any inner bulge which may exist near the upper edge of the package rim. While these same purposes could be accomplished by merely widening the spacing between the prongs 2 and 3, the presence of the point 16 causes the shorter prong 3 to bear at said point 16 against the inner side of the package rim and thereby steady and render more accurate the operation of the entire device. However, it will be apparent that these dimensions can also be varied somewhat so long as the operations above described are not hindered.

As to the length of the longer prong 2, this needs only be long enough to insure a firm bearing thereof against the outside of the package and may be varied widely within the limits of its capacity to perform this function.

While the embodiment of the foregoing description has assumed that both of prongs 2 and 3 extend in the same direction as the handle 1 and comprise in general a continuation thereof, it will be apparent that said prongs may also extend in other directions with respect to the handle, such as perpendicular with respect thereto, provided only the other relationships above described in connection with said prongs 2 and 3 are retained. Although a particular preferred embodiment of the invention Although has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an opening device for a coin package, said package having an end closure portion and an axially extending turned-over rim retaining said end closure portion, the combination comprising:

a manually graspable handle terminating in a rigid plate-like portion divided into only two prongs;

the first said prong extending in one direction from said handle;

the second said prong extending from said handle in the same said direction and flanked at one side thereof by said first prong and spaced therefrom by a gap, the second prong having a free end locatable adjacent the end closure piece of said package in response to straddling of the rim of said package by said prongs, said first prong being several times longer than said second prong, said first prong having a linear inside edge facing toward said second prong and protruding several second prong lengths beyond said second prong, so as to lie snugly in axially extended contact with the coin package periphery, the inside edge of said second prong having a portion extending toward said first prong;

rim releasing means projecting from said second prong adjacent said free end thereof in a direction away from the first prong and responsive to twisting of said handle for pushing the opposed part of said rim out of its normal retaining position.

2. An opening device for a tearable coin package of the type having a peripheral wall and a turned-over rim extending from the end of said package, said device comprising in combination:

a handle;

a longer prong means extending from said handle for placement lengthwise along the outside of said package;

a substantially shorter prong means extending from said handle alongside said longer prong means for placement endways substantially against the end of said package;

said longer and shorter prong means being transversely spaced by a gap for free but close reception of said end rim therein, the free end of said shorter prong means having a rim releasing point means extending transversely thereof and responsive to progressive twisting of said handle substantially about the longitudinal axis of said gap for pressing transversely outward against and loosening said package rim, said device being a rigid plate with one corner portion omitted to leave said longer and shorter prong means, and a central portion between said prong means omitted to define said gap, said longer prong means being a blunt prong, said gap ending in an enlarged opening of diameter exceeding the width of the mouth of said gap.

3. The device of claim 1 wherein said second prong is provided with a recess in the edge thereof facing said first prong.

4. The device of claim 1 wherein said rim releasing means is defined by a recess cut into said second prong on the side thereof remote from said first prong.

5. The device of claim 2 in which said second prong means includes a rim lifting ramp means for insertion under and lifting of said rim at the free inboard rim edge, said lifting means being immediately inboard of said point means, said point means being shaped by said ramp and by the free end of said second prong means.

6. The device of claim 5 in which said shorter prong means is a flat plate-like element of thickness substantially less than width.

* * * * *